US007921913B2

(12) United States Patent
Tchakarov et al.

(10) Patent No.: US 7,921,913 B2
(45) Date of Patent: Apr. 12, 2011

(54) VACUUM INSULATED DEWAR FLASK

(75) Inventors: Borislav J. Tchakarov, Humble, TX (US); Paul G. Junghans, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 190 days.

(21) Appl. No.: 11/264,547

(22) Filed: Nov. 1, 2005

(65) Prior Publication Data

US 2007/0095543 A1 May 3, 2007

(51) Int. Cl.
*E21B 36/00* (2006.01)
*E21B 47/01* (2006.01)

(52) U.S. Cl. ..... 166/302; 166/57; 166/162; 166/250.11

(58) Field of Classification Search ..... None
See application file for complete search history.

(56) References Cited

U.S. PATENT DOCUMENTS

| | | | | |
|---|---|---|---|---|
| 3,007,596 | A * | 11/1961 | Matsch | 220/560.13 |
| 3,038,074 | A * | 6/1962 | Scherbatskoy | 250/261 |
| 3,859,523 | A | 1/1975 | Wilson et al. | |
| 4,375,157 | A | 3/1983 | Boesen | |
| 4,407,136 | A | 10/1983 | de Kanter | |
| 4,440,219 | A | 4/1984 | Engelder | |
| 4,513,352 | A | 4/1985 | Bennett et al. | |
| 5,144,245 | A | 9/1992 | Wisler | |
| 5,243,835 | A | 9/1993 | Padamsee | |
| 5,280,243 | A | 1/1994 | Miller | |
| 5,547,028 | A | 8/1996 | Owens et al. | |
| 5,720,342 | A | 2/1998 | Owens et al. | |
| 5,730,217 | A | 3/1998 | Owens et al. | |
| 5,816,311 | A | 10/1998 | Osada et al. | |
| 5,968,618 | A | 10/1999 | Miller | |
| 6,134,892 | A | 10/2000 | Turner et al. | |
| 6,336,408 | B1 | 1/2002 | Parrott et al. | |
| 6,341,498 | B1 * | 1/2002 | DiFoggio | 62/259.2 |
| 6,688,127 | B2 | 2/2004 | Laubacher et al. | |
| 6,769,487 | B2 | 8/2004 | Hache | |
| 6,877,332 | B2 | 4/2005 | DiFoggio | |
| 7,220,365 | B2 * | 5/2007 | Qu et al. | 252/70 |
| 2002/0114937 | A1 | 8/2002 | Albert et al. | |
| 2002/0121097 | A1 | 9/2002 | Chiu et al. | |
| 2004/0040716 | A1 | 3/2004 | Bursaux | |
| 2004/0093887 | A1 | 5/2004 | Shyy et al. | |
| 2004/0112601 | A1 | 6/2004 | Hache | |
| 2004/0140096 | A1 | 7/2004 | Sandberg et al. | |
| 2004/0182091 | A1 | 9/2004 | Wang et al. | |
| 2004/0194489 | A1 | 10/2004 | Pode | |
| 2005/0103497 | A1 | 5/2005 | Gondouin | |
| 2005/0269092 | A1 | 12/2005 | Vinegar | |
| 2006/0005968 | A1 | 1/2006 | Vinegar et al. | |
| 2006/0086506 | A1 | 4/2006 | Golla et al. | |

FOREIGN PATENT DOCUMENTS

SU 561553 A * 1/1977

* cited by examiner

*Primary Examiner* — Zakiya W. Bates
(74) *Attorney, Agent, or Firm* — Bracewell & Giuliani LLP

(57) ABSTRACT

An apparatus and method for protecting temperature sensitive components from the extreme temperatures a hydrocarbon producing wellbore. The apparatus comprises an inner housing encompassed by an exterior housing, where a plenum is formed between the two housings. A vacuum is formed within the plenum. The temperature sensitive components are stored within the inner housing. An aerogel composition is placed on the outer surface of the inner housing thereby providing added insulation for protecting the temperature sensitive component. Optionally the aerogel composition can be added to the inner surface of the outer housing. Yet further optionally, a reflective foil may be disposed over the aerogel composition of the inner housing.

23 Claims, 2 Drawing Sheets

VACUUM INSULATED DEWAR FLASK

FIELD OF THE DISCLOSURE

The present invention relates to the field of the exploration and production of hydrocarbons from within subterranean formations. The present invention further relates to an apparatus and method for protecting temperature sensitive components while in use in a hydrocarbon wellbore.

BACKGROUND INFORMATION

In underground drilling applications, such as for the production of oil and gas, a wellbore or bore hole is drilled through a formation deep in the earth. Such bore holes are drilled or formed by a drill bit connected to end of a series of sections of drill pipe, so as to form an assembly commonly referred to as a "drill string". The drill string extends from the surface to the bottom of the bore hole. As the drill bit rotates, it advances into the earth, thereby forming the bore hole. In order to lubricate the drill bit and flush cuttings from its path as it advances, a high pressure fluid, referred to as "drilling mud," is directed through an internal passage in the drill string and out through the drill bit. The drilling mud then flows to the surface through an annular passage formed between the exterior of the drill string and the surface of the bore.

The distal or bottom end of the drill string, which includes the drill bit, is referred to as a "down hole assembly." In addition to the drill bit, the down hole assembly often includes specialized modules or tools within the drill string that make up the electrical system for the drill string. Such modules often include sensing modules, a control module and a pulsar module. In many applications, the sensing modules provide the drill string operator with information regarding the formation as it is being drilled through, using techniques commonly referred to as "measurement while drilling"(MWD) or "logging while drilling"(LWD). For example, resistivity sensors may be used to transmit and receive high frequency signals (c.g., electromagnetic waves) that travel through the formation surrounding the sensor.

The construction of one such device is shown in U.S. Pat. No. 5,816,311 (Turner). By comparing the transmitted and received signals, information can be determined concerning the nature of the formation through which the signal has traveled, and whether the formation contains water or hydrocarbons. One such method for sensing and evaluating the characteristics of the formation adjacent to the bore hole is disclosed in U.S. Pat. No. 5,144,245 (Wisler). Other sensors are used in conjunction with magnetic resonance imaging (MRI) such as that disclosed in U.S. Pat. No. 5,280,243 (Miller). Still other sensors include gamma scintillator, which are used to determine the natural radioactivity of the formation, and nuclear detectors, which are used to determine the porosity and density of the formation.

In other applications, sensing modules are utilized to provide data concerning the direction of the drilling and can be used, for example, to control the direction of a steerable drill bit as it advances. Steering sensors may include a magnetometer to sense azimuth and an accelerometer to sense inclination. Signals from the sensor modules are typically received and processed in the control module of the down hole tool. The control module may incorporate specialized electronic components to digitize and store the sensor data.

Temperature sensitive components used for downhole operations are not limited to drilling applications but can also be utilized in wireline tools. As is well known, wireline tools include perforators, logging tools, bond evaluation tools, formation testing devices, and seismic acquisition, to name but a few.

As can be readily appreciated, such electrical systems will include many sophisticated electronic components, such as the sensors themselves, which in many cases include printed circuit boards. Additional associated components for storing and processing data in the control module may also be included on printed circuit boards. Unfortunately, many of these electronic components generate heat that are also susceptible to damage resulting from the generated heat. This is in addition to the thermal energy inherently provided by the subterranean formations surrounding the wellbore. For example, the components of a typical MWD system or a system attached to a wireline, such as but not limited to, a magnetometer, accelerometer, solenoid driver, microprocessor, power supply and gamma scintillator, may generate over 20 watts of heat. Moreover, even if the electronic component itself does not generate heat, the temperature of the formation itself typically exceeds the maximum temperature capability of the components.

Overheating frequently results in failure or reduced life expectancy for thermally exposed electronic components. For example, photo multiplier tubes, which are used in gamma scintillator and nuclear detectors for converting light energy from a scintillating crystal into electrical current, cannot operate above 175° C. Consequently, cooling of the electronic components is important. Unfortunately, cooling is made difficult by the fact that the temperature of the formation surrounding deep wells, especially geothermal wells, is typically relatively high, and may exceed 200° C.

Certain methods have been proposed for protecting such electronic components during hydrocarbon exploration and production operations within a wellbore. One such approach, which requires isolating the electronic components from the formation by incorporating them within a vacuum insulated Dewar flask, is shown in U.S. Pat. No. 4,375,157 (Boesen). The Boesen device includes thermoelectric coolers that are powered from the surface. The thermoelectric coolers transfer heat from the electronics area within the Dewar flask to the well fluid by means of a vapor phase heat transfer pipe. Such approaches are not suitable for wellbore use since the size of such configurations makes them difficult to package into a down hole assembly.

Another approach, as disclosed in U.S. Pat. No. 5,547,028 (Owens) involves placing a thermoelectric cooler adjacent to an electronic component or sensor located in a recess formed in the outer surface of a well logging tool. This approach, however, does not ensure that there will be adequate contact between the components to ensure efficient heat transfer, nor is the electronic component protected from the shock and vibration that it would experience in a drilling application.

Thus, one of the prominent design problems encountered in down hole logging tools is associated with overcoming the extreme temperatures encountered in the down hole environment. Thus, there exists a need to protect components and electronics of wellbore tools during use thereby maintaining the temperature of the components to within the safe operating level of the electronics. Various schemes have been attempted to resolve the temperature differential problem to keep the tool temperature below the maximum electronic operating temperature, but none of the known techniques have proven satisfactory.

Down hole tools are exposed to tremendous thermal strain. The down hole tool housing is in direct thermal contact with the bore hole drilling fluids and conducts heat from the bore hole drilling fluid into the down hole tool housing. Conduction of heat into the tool housing raises the ambient temperature inside of the electronics chamber. Thus, the thermal load on a non-insulated down hole tool's electronic system is enormous and can lead to electronic failure. In the event of electronic failure, down hole operations must be interrupted while the down hole tool is removed from deployment and repaired. Thus, various methods have been employed in an attempt to reduce the thermal load on all the components, including the electronics and sensors inside of the down hole tool. To reduce the thermal load, down hole tool designers have tried surrounding electronics with thermal insulators or placed the electronics in a vacuum flask. Such attempts at thermal load reduction, while partially successful, have proven problematic in part because of heat conducted from outside the electronics chamber and into the electronics flask via the feed-through wires connected to the electronics. Moreover, heat generated by the electronics trapped inside of the flask also raises the ambient operating temperature.

Typically, the electronic insulator flasks have utilized materials having a low thermal conductivity to insulate the electronics to retard heat transfer from the bore hole into the down hole tool and into the electronics chamber. Designers place insulators adjacent to the electronics to retard the increase in temperature caused by heat entering the flask. The design goal is to keep the ambient temperature inside of the electronics chamber flask below the critical temperature at which electronic failure may occur. Designers seek to keep the temperature below critical for the duration of the logging run, which is usually less than 12 hours for wireline operations.

Electronic container flasks, unfortunately, take as long to cool down as they take to heat up. Thus, once the internal flask temperature exceeds the critical temperature for the electronics, it requires many hours to cool down before an electronics flask can be used again safely. Thus, there is a need to provide an electronics and or component cooling system that actually removes heat from the flask or electronics/sensor region without requiring extremely long cool down cycles that impede down hole operations. As discussed above, electronic cooling via thermoelectric and compressor cooling systems has been considered, however, neither have proven to be viable solutions.

Thermoelectric coolers require too much external power for the small amount of cooling capacity that they provide. Moreover, few if any of the thermoelectric coolers are capable of operating at down hole temperatures. Additionally, as soon as the thermoelectric cooler system is turned off, the system becomes a heat conductor that enables heat to rapidly conduct through the thermoelectric system and flow back into the electronics chamber from the hotter regions of the down hole tool. Compressor-based cooling systems also require considerable power for the limited amount of cooling capacity they provide. Also, most compressors seals cannot operate at the high temperatures experienced down hole because they are prone to fail under the thermal strain.

Thus a need exists for shielding downhole components from the excessive thermal heating present within wellbore environments.

SUMMARY OF THE DISCLOSURE

The scope of the present disclosure includes a well flask comprising an outer housing, an internal housing disposed within said outer housing, a plenum between said internal housing and the external housing, and an insulating layer disposed on the outer surface of the internal housing, wherein the insulating layer is comprised of an aerogel composition.

The aerogel composition can have a heat transfer coefficient from about 0.0005 W/m °K to about 0.0500 W/m °K and can be disposed in an environment comprised substantially of air and has a heat transfer coefficient of about 0.016 W/m °K. Similarly, when disposed in a substantially evacuated environment and the heat transfer coefficient can be about 0.004 W/m °K.

The well flask can further comprise an insulating layer disposed on the inner surface of the external housing, wherein the insulating layer is comprised of a material having a low thermal conductivity. Optionally, the insulating layer may be comprised of an aerogel composition and further optionally, can have a heat transfer coefficient from about 0.0005 W/m °K to about 0.0500 W/m °K.

The well flask may further comprise reflective foil disposed on the insulating layer and may include a vacuum within the plenum. The internal housing of the well flask can be formed to receive a downhole instrument.

The scope of the present disclosure also includes a method of protecting a downhole measuring component against wellbore ambient conditions comprising, forming an elongated housing having an open end and a closed end, inserting a downhole measuring component into the open end of the elongated housing, securing the downhole measuring component within the elongated housing, coating the outer surface of the elongated housing with insulation, wherein the insulation comprises an aerogel composition, circumscribing the elongated housing with an outer housing thereby forming a sealed plenum between the outer surface of the elongated housing and the inner surface of the outer housing, and forming a vacuum within the plenum.

Optionally, the method may further comprise coating the inner surface of the outer housing with insulation, wherein the insulation comprises an aerogel composition. The method can further comprise adding a layer of reflective material on the aerogel composition.

Another embodiment of a wellbore flask is included that comprises, an outer housing, an inner housing insertably disposed within the outer housing, a reflective foil between the inner housing and the outer housing, and a support affixed to the reflective foil. The support may comprise an insulating material, wherein the insulating material can be an aerogel composition.

The support can be affixed on one side to said reflective foil and on another side to said outer housing, can be affixed on one side to said reflective foil and on another side to said inner housing. An additional support member can be included, wherein the support is affixed on one side to said reflective foil and on another side to the outer housing and the additional support member is affixed on one side to the reflective foil and on another side to the inner housing. The support may be formed as an annular structure coaxially circumscribing a portion of the inner housing.

DETAILED DISCLOSURE

The present disclosure concerns an apparatus and method for protecting components used within a wellbore during the exploration and production of hydrocarbons from within the wellbore and from formations adjacent the wellbore. More specifically, an improved device and method is presented herein for shielding these downhole components from the high temperatures ambient within such wellbores. The improved device and method serves to reduce heat transfer to the component both in the form of conduction and radiation.

Figure 1:
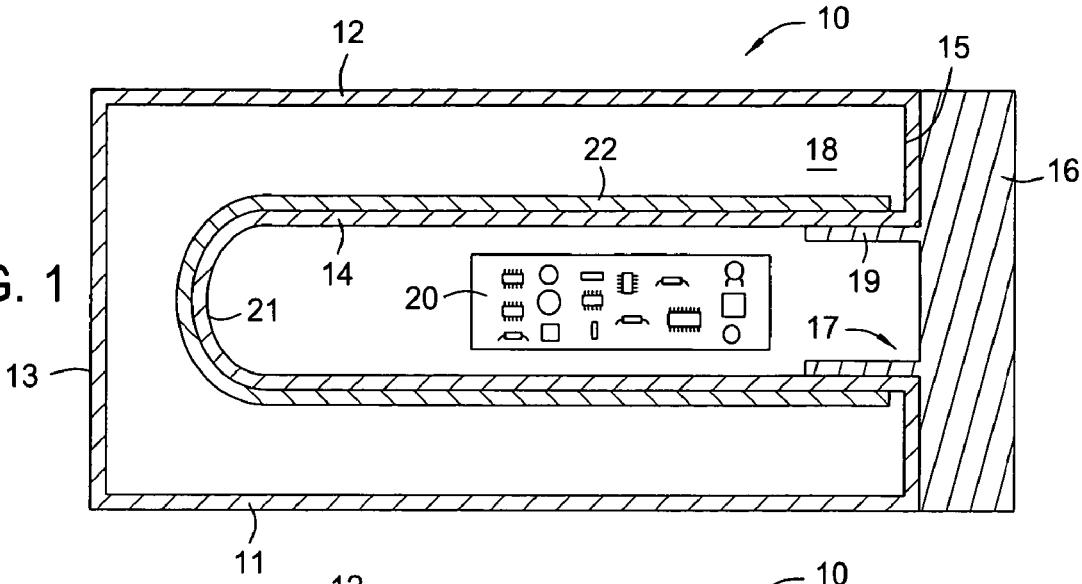
FIG. 1 is a partial cutaway view of an embodiment of a wellbore flask.

With reference now to FIG. 1, one embodiment of a flask 10 is presented. Here the flask 10 is comprised of an external housing 12 surrounding an internal housing 14, with a plenum 18 formed between the housings. Typically the plenum 18 region is substantially evacuated thereby creating a vacuum therein. As shown, a component 20 is secured within the internal housing. The component 20 may be an instrument comprised of electrical or analog elements. The use of the component 20 may be used during any aspect of downhole exploration and/or production operations.

The external housing 12 is preferably substantially cylindrical whose outer dimensions and configuration makes it suitable for insertion into and traversal through a wellbore of interest. The external housing 12 is largely hollow and is comprised of an outer wall 11 along its length, where the outer wall 11 is bounded on one end by a closed end 13 and on its other end by a lip 15. The closed end 13 has a disk like shape and is formed for its outer periphery to match the contour of the end of the outer wall 11. The closed end 13 can be integrally formed onto the outer wall 11, such as by cold rolling, or can be secured by attachment means such as welding and the like. Similarly, the lip 15 has a circular outer periphery that likewise fits into the opposing end of the external housing at the edge of the outer wall 11. The lip 15 extends only along a portion of the inner radius of the external housing 12 thus when viewed axially provides an annular profile. The lip 15 also can be integrally formed with the external housing 12 or attached later by welding or other attachment means.

As is described in more detail herein, a vacuum exists in the space between the external housing 12 and the internal housing 14, thus the structural integrity of the outer wall 11 should be sufficient to handle the pressure differential of many thousands of pounds per square inch that can exist within a wellbore. Potential materials for use with the external housing 12 include carbon steel, stainless steel, high strength alloys, and other materials used in high pressure applications. Optionally, the entire flask 10 can be packaged within a pressure housing. It is within the scope and capabilities of those skilled in the art to appropriately design an outer wall 11 having such sufficient strength.

The internal housing 14 is also preferably cylindrical is coaxially positioned within the hollow space of the external housing 12. As shown in FIG. 1, the closed end 21 of the internal housing 14 has a semi-circular cross section, but could take on any other shape. The internal housing 14 is joined at its open end 17 to the disk like lip 15 that perpendicularly extends from the outer wall 11 of the external housing 12. Joining the internal housing 14 to the external housing 12 provides a pressure seal on this side of the respective housings and the presence of the closed end 13 adds a pressure seal on the other end.

The primary function of the plenum 18 is to provide a non-thermally conductive shield around the internal housing 14 to minimize thermal heat transfer to the component 20 housed within the internal housing 14. As is known, thermal energy does not conduct through a vacuum space. Thus surrounding the component 20 with a vacuum space can virtually eliminate heat conduction to the component 20. Thus once the flask 10 is assembled, the plenum space 18 is evacuated to remove all resident gas, such as air, or other fluids. The evacuation of the plenum 18 can be accomplished through a sealed valve stem (not shown) that extends through the external housing 12 into the plenum 18. The combination of the lip 15 on one end of the external housing 12 and the closed end 13 on the other end seals the plenum 18 from fluid flow into or out of the plenum 18. This sealing function prevents fluid leakage into or out of the plenum 18.

The flask 10 further comprises a cap 16 that covers the open end 17 of the internal housing 14 and protects the inside of the internal housing 14 from the harsh downhole conditions. Extending from the primary base of the cap 16 into the open end 17 is a tubular shaped sleeve 19 whose outer circumference closely matches the inner surface of the internal housing 14. The sleeve 19 helps to mate the cap 16 with the remainder of the flask 10 and also adds additional sealing surface to exclude wellbore fluids from entering the inside of the internal housing 14.

A layer of insulation 22 is shown covering the outer surface of the internal housing 14. In addition to the vacuum in the plenum 18, the insulation 22 minimizes the exposure of thermal energy from within the wellbore to the component 20. Optionally, the insulation may be comprised of an aerogel composition such as obtained from NanoPore Incorporated, 2501 Alamo Ave. SE, Albuquerque, N. Mex. 87106. This composition is a porous solid having a low density and very small pores. It can be comprised of a mixture of silica, titania, and/or carbon in three dimensional highly branched network of primary particles that aggregate into larger particles. Because of the unique pore structure of the aerogel composition, the thermal insulating performance of the present apparatus can range from of 0.0005 to 0.0500 W/m °K. More specifically, the aerogel composition has a heat transfer coefficient of about 0.016 W/m oK in air and about 0.004 W/m °K within a vacuum. The presence of the aerogel composition effective eliminates radiation transfer across its surface. Its preferred coefficient of heat transfer is about 0.0016 W/cm °K. For the application described herein, it is expected that the aerogel have a thickness of about 0.1 inches to about 0.25 inches.

Figure 2:
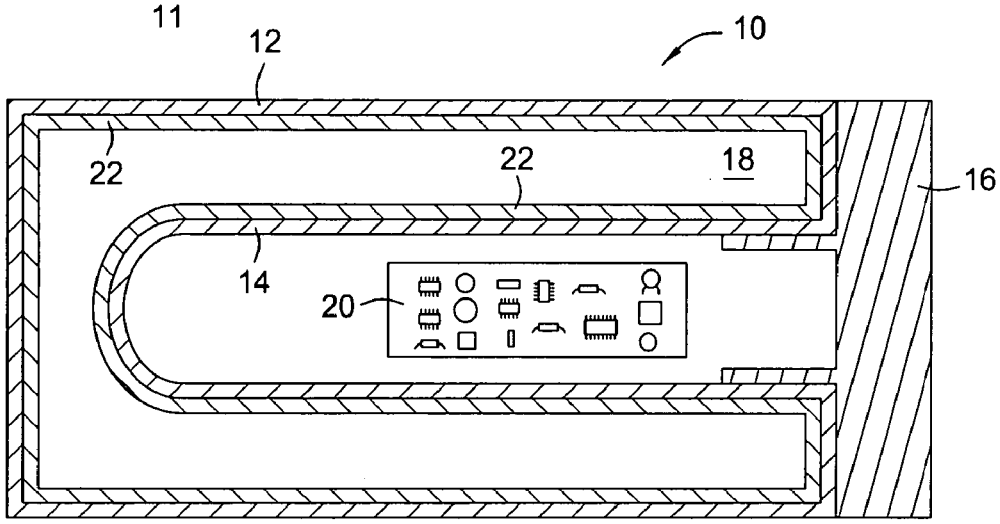
FIG. 2 is a partial cutaway view illustrating an optional embodiment of a wellbore flask.

With reference now to FIG. 2, an alternative embodiment is shown. Here the configuration of the flask 10 is essential the same as that of FIG. 1, however an added layer of insulation 22 is shown applied to the inner surface of the external housing 12. This added layer of insulation on the inner surface of the external housing 12 is preferably comprised of the aerogel as above described applied to the internal housing 14.

Figure 3:
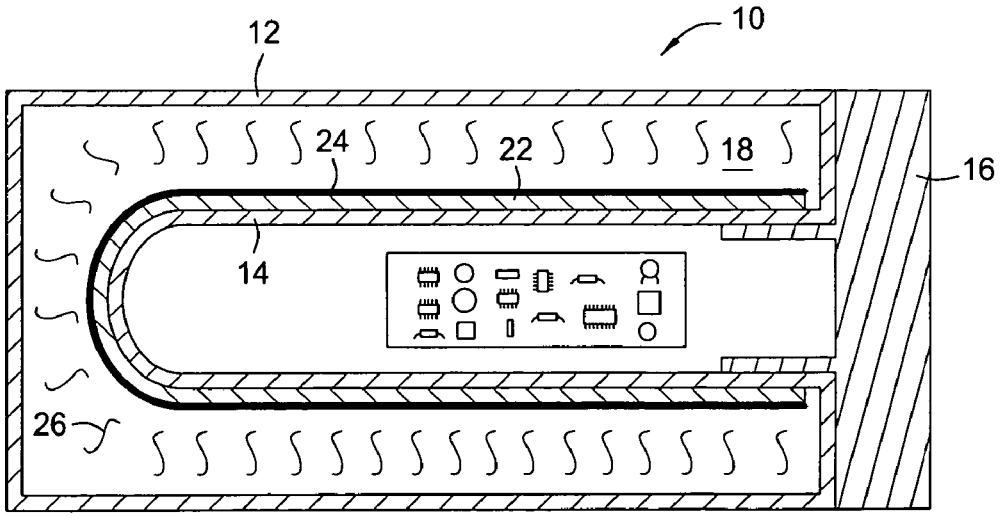
FIG. 3 is a partial cutaway view illustrating yet another optional embodiment of a wellbore flask.

Referring now to FIG. 3, another embodiment of the flask 10 is shown, here an added layer of reflective foil 24 is illustrated on the exterior of the insulation 22 of the internal housing 14. The reflective foil 24 can be comprised of one or more layers of gold foil, copper foil, aluminum foil, aluminized polyester, or some other substance having a "mirror" type reflecting outer surface. The foil 24 provides a shield capable of reflecting radiation energy, represented by the lines 26 that might pass through the external housing 12 from outside of its surface. Thus the reflective foil 24 should have highly reflective characteristics to further slow down the radiation heat transfer between the external and internal housings (12, 14).

Figure 4:
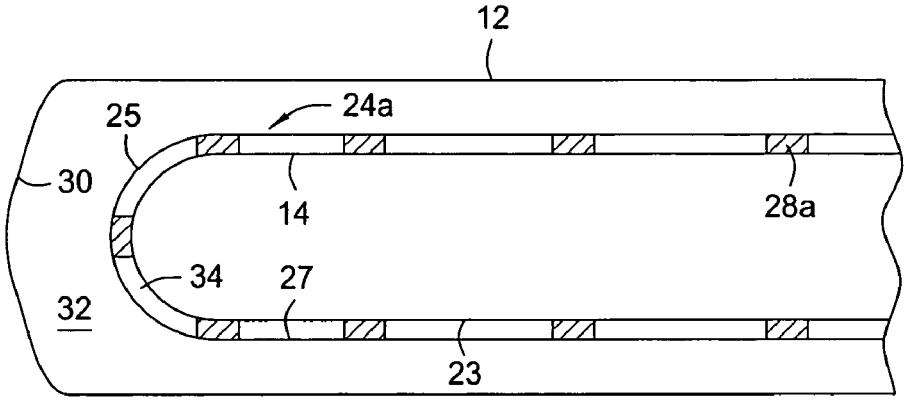
FIG. 4 is a cross sectional view of a portion of an embodiment of a wellbore flask.

An additional embodiment of a flask 10 in accordance with the present disclosure is presented in FIG. 4. There a portion of a flask 10 is shown in a cross sectional view. The flask 10 comprises an internal housing 14 disposed within an external housing 12 with a reflective foil 24 therebetween. Because the reflective foil 24 is typically thin it thus requires some structural support to remain in place without buckling under its own load or during use. In the embodiment of FIG. 4, supports 28 are shown affixed to the foil inner surface 27 and the housing outer surface 23, thereby securing the reflective foil 24 to the internal housing 14. The supports 28 are supplied at locations along the length of the foil 24 depending on the strength of the foil 24. Those skilled in the art can determine the proper distance between supports 28 to ensure the supports 28 maintain the structural integrity of the foil 24. An inner plenum 34 is formed between the foil 24 and the internal housing 14. An external plenum 32 is formed between the foil 24 and the external housing 12.

Figure 5:
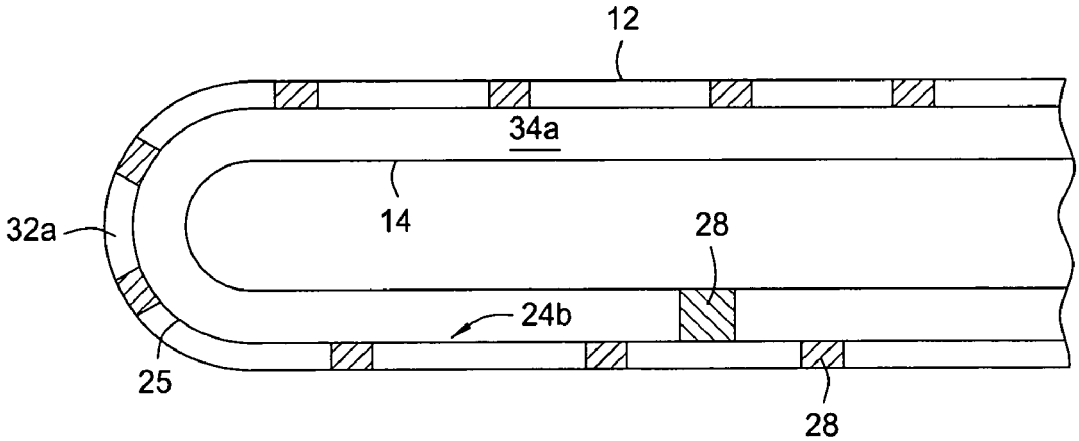
FIG. 5 is a cross sectional view of a portion of another embodiment of a wellbore flask.

The embodiment of FIG. 5 also includes supports, however these supports 28 are between the outer surface of the foil 24 and the inner surface of the external housing 12. An additional embodiment includes supports 28 on both sides of the foil 24 so structural support could be realized by attaching supports 28 to both the internal housing 14 and the foil 24 and the external housing 12 and the foil 24.

The configuration of the supports 28 can be individual rectangular blocks disposed in the plenums (outer plenum 32 or inner plenum 34), or can also be annular ringlike members that coaxially circumscribe the outer diameter of the internal housing 14 or adhere to the inner surface of the external housing 12.

Optionally, for the embodiments of both FIG. 4 and FIG. 5 the surfaces of the foil 24, internal housing 14, and the external housing 12 can be finished for minimizing heat transfer across those surfaces. For example, the inner surface 30 of the external housing 12 and the foil inner surface 27 can be that of a "black body" that reflects little or no radiation while absorbing substantially all radiation or thermal energy they are exposed to. Both the housing outer surface 23 and the foil outer surface 25 can be a "white body" for reflecting substantially all thermal energy and/or radiation while absorbing little or no energy. Optionally these surfaces can have a polished or mirrored finish.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the insulation 22 can be comprised of numerous other substances, such as nanoporous coating compositions, a nanoporous silica film, polystyrene, or a sorption cooler. Additionally, the supports 28 can be comprised of any of the aforementioned insulating materials including combinations thereof. The supports 28 can also comprise any other material capable of accomplishing its supporting function and this other material may be combined with the insulating materials (and combinations thereof). These and other similar modifications will readily suggest themselves to those skilled in the art, and are intended to be encompassed within the spirit of the present invention disclosed herein and the scope of the appended claims.

What is claimed is:

1. An insulating flask comprising:

an external housing having a closed end;

an internal housing having a closed end and disposed within said external housing;

a vacuum space between the external housing and the internal housing;

a reflective layer disposed in the vacuum space, spaced apart from the internal housing, spaced apart from the external housing, and in the space between the closed ends of the internal and external housing; and an insulating layer disposed between said internal housing and said external housing, wherein the insulating layer comprises a low density porous solid having very small pores.

2. The insulating flask of claim 1, wherein said insulating layer has a heat transfer coefficient from about 0.0005 W/m° K to about 0.0500 W/m° K.

3. The insulating flask of claim 1 further comprising a plenum disposed between said internal housing and external housing, wherein the atmosphere in the plenum comprises a substantially air filled atmosphere.

4. The insulating flask of claim 1 wherein the insulating layer is disposed on said external housing.

5. The insulating flask of claim 4 further comprising another insulating layer on the internal housing.

6. The insulating flask of claim 1, wherein the insulating layer is disposed on said internal housing.

7. The insulating flask of claim 1 further comprising a reflective layer disposed on said insulating layer.

8. The insulating flask of claim 1 wherein said internal housing is formed to receive therein a downhole instrument.

9. The insulating flask of claim 1, wherein the insulating layer comprises an aerogel composition.

10. The insulating flask of claim 1, wherein the insulating layer comprises a mixture of components selected from the list consisting of silica, titania, and carbon.

11. The insulating flask of claim 1, wherein the insulating layer comprises a three dimensional highly branched network of primary particles that aggregate into larger particles.

12. The insulating flask of claim 1 further comprising a plenum disposed between said internal housing and external housing, wherein the atmosphere in the plenum comprises a vacuum.

13. A method of insulating a downhole component against downhole temperature comprising:

inserting a downhole component into an inner housing;

circumscribing the inner housing with an outer housing, wherein space is provided between the inner housing and the outer housing;

providing a reflective layer in the space and spaced apart from the inner housing and the outer housing; and disposing an insulating composition between the housing and the outer housing, wherein the insulating composition comprises a low density porous solid having very small pores.

14. The method of claim 13, wherein said insulating composition has a heat transfer coefficient of about 0.0016 W/cm° K.

15. The method of claim 13 wherein the insulating composition is disposed on the outer surface of the housing.

16. The method of claim 13 further comprising adding a layer of reflective material on the insulating composition.

17. The method of claim 13, wherein the insulating composition is an aerogel composition.

18. The method of claim 13 wherein the insulating composition is disposed on the inner surface of the outer housing.

19. The method of claim 18 further comprising applying the insulating composition to the outer surface of the housing.

20. An insulating flask comprising:

an outer housing;

an inner housing disposed within said outer housing;

a reflective layer between said inner housing and said outer housing spaced apart from the inner housing and the outer housing; and spaced apart supports comprised of an aerogel composition affixed between a side of the reflective layer and one of the inner housing and outer housing.

21. The insulating flask of claim 20, wherein said support comprises an insulating material.

22. The insulating flask of claim 21, wherein the insulating material is comprised of a low density porous solid having very small pores.

23. The insulating flask of claim 20, wherein said supports comprises annular structures coaxially circumscribing a portion of said inner housing.

* * * * *